US006203375B1

(12) United States Patent
Chang

(10) Patent No.: US 6,203,375 B1
(45) Date of Patent: Mar. 20, 2001

(54) METAL SHIELD AND CABLE ARRANGEMENT FOR AN ELECTRIC CONNECTOR

(75) Inventor: Chih-Kai Chang, Taipei Hsien (TW)

(73) Assignee: Tekcon Electronics Corporation, Taipei Hsien (TW)

( * ) Notice: Subject to any disclaimer, the term of this patent is extended or adjusted under 35 U.S.C. 154(b) by 0 days.

(21) Appl. No.: 09/468,355

(22) Filed: Dec. 21, 1999

(51) Int. Cl.[7] ..... H01R 13/648
(52) U.S. Cl. ..... 439/607; 439/610; 439/465
(58) Field of Search ..... 439/607, 608, 439/609, 610, 465

(56) References Cited

U.S. PATENT DOCUMENTS 4,449,778 * 5/1984 Lane ..... 439/610
5,167,523 * 12/1992 Crimmins et al. ..... 439/350
5,195,909 * 3/1993 Huss, Jr. et al. ..... 439/465
6,089,916 * 7/2000 Kuo ..... 439/610
6,109,969 * 8/2000 Kuo et al. ..... 439/610

* cited by examiner

*Primary Examiner*—Gary Paumen
*Assistant Examiner*—Ross Goshi
(74) *Attorney, Agent, or Firm*—Robert E. Bushnell, Esq.

(57) ABSTRACT

A metal shield and cable arrangement, which includes two cover shells fastened together, two shielding shells mounted in between the cover shells to hold a terminal holder, and a cable inserted in between the shielding shells and connected to terminals in the terminal holder, wherein the cover shells each have a neck at one end and a stub rod disposed in the neck; the shielding shells each have a neck fitted into the neck at one cover shell, a through hole coupled to the stub rod in the neck at one cover shell, and a retaining flange of smoothly arched cross section supported on the stud rod in the neck at one cover shell and forced by the stub rod against the periphery of the cable.

16 Claims, 4 Drawing Sheets

METAL SHIELD AND CABLE ARRANGEMENT FOR AN ELECTRIC CONNECTOR

BACKGROUND OF THE INVENTION

The present invention relates to an electric connector, and more particularly to a metal shield and cable arrangement for an electric connector, in which two identical metal shielding shells are mounted in between two cover shells and forced by the cover shells to hold down a cable in therebetween.

Regular electric connectors for use with a computer, printer, or any of a variety of electronic apparatus commonly comprise a terminal holder mounted within a cover shell and holding a set of terminals, and a cable connected to the terminals in the terminal holder. In order to eliminate electromagnetic interference (i.e., EMI), a metal shield or the like shall be used. Further, in order to hold the cable in place, a special cable fastening arrangement is needed. For example, clamping devices are used with the metal shielding shells for securing the cable in place (see FIG. 5). However, the installation of the additional clamping devices greatly increases the cost of the electric connector, and complicates its assembly procedure.

SUMMARY OF THE INVENTION

The present invention has been accomplished to provide a metal shield and cable arrangement for an electric connector, which eliminates the aforesaid drawbacks. According to one aspect of the present invention, the metal shield and cable arrangement comprises two cover shells fastened together, two shielding shells mounted in between the cover shells to hold a terminal holder, and a cable inserted in between the shielding shells and connected to terminals in the terminal holder, wherein the cover shells each have a neck at one end and a stub rod disposed in the neck; the shielding shells each have a neck fitted into the neck at one cover shell, a through hole coupled to the stub rod in the neck at one cover shell, and a retaining flange of smoothly arched cross section supported on the stud rod in the neck at one cover shell and forced by the stub rod against the periphery of the cable. According another aspect of the present invention, the shielding shells are of identical metal shells made of metal by stamping.

DETAILED DESCRIPTION OF THE PREFERRED EMBODIMENT

Figure 1:
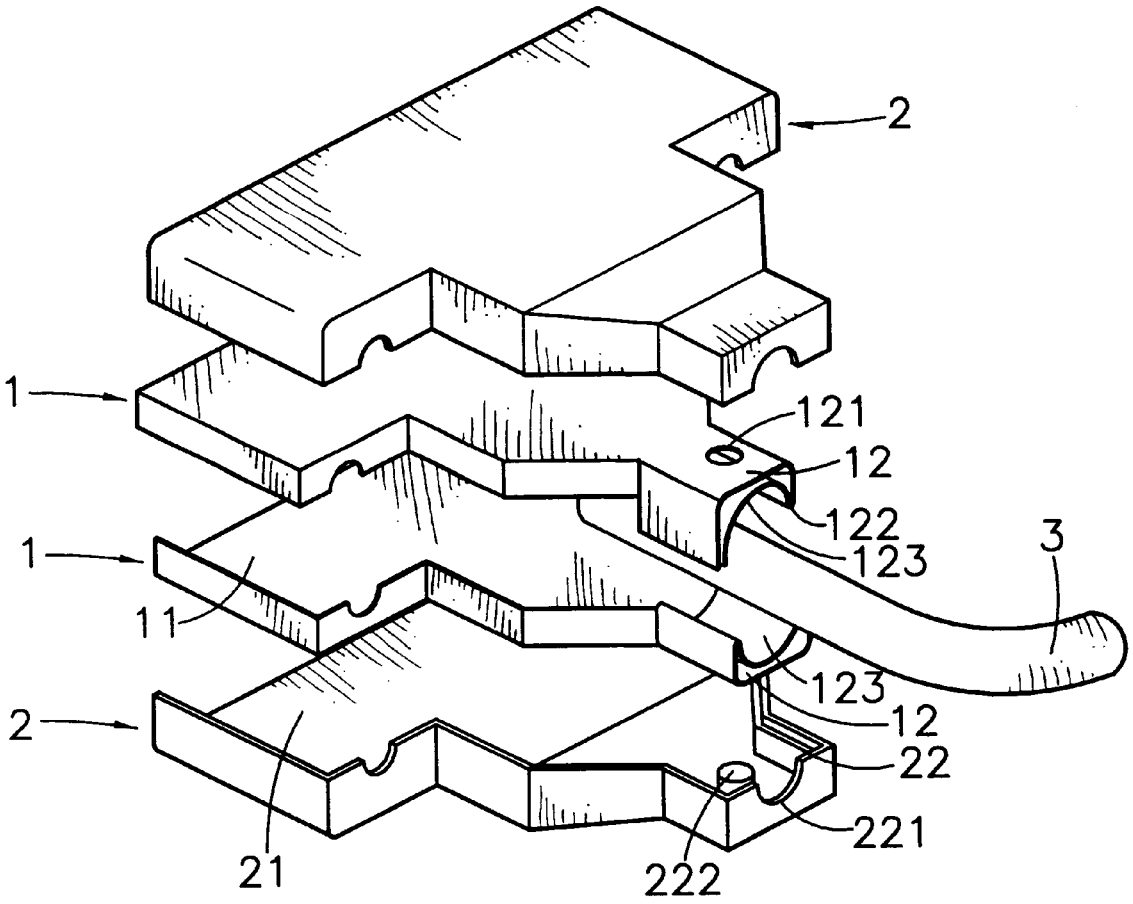
FIG. 1 is an exploded view of the present invention.
Figure 2:
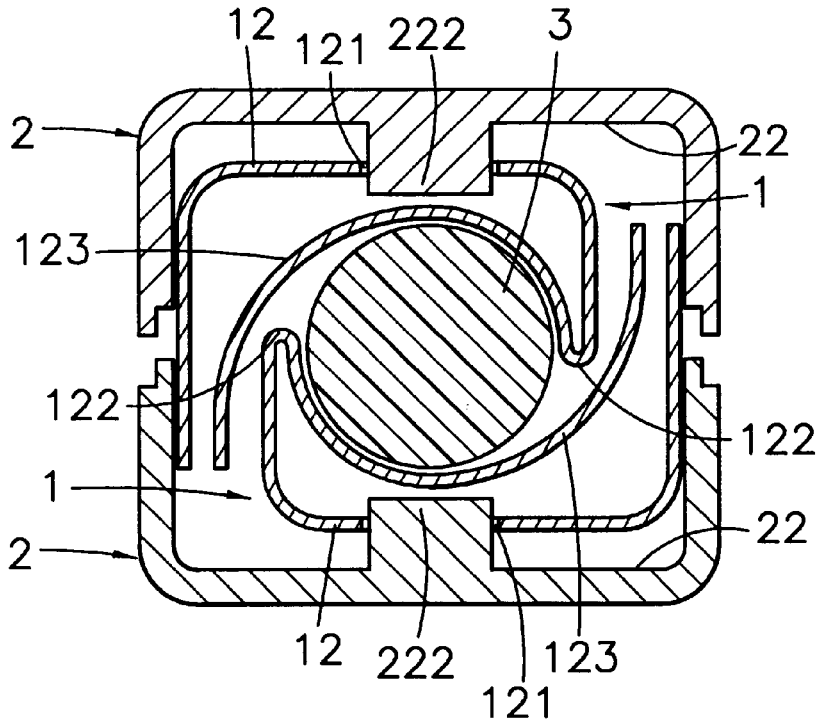
FIG. 2 is a sectional view of the present invention during assembly.

Referring to FIGS. 1 and 2, the present invention comprises two shielding shells 1, two cover shells 2, and a cable 3. The shielding shells 1 are mounted in between the cover shells 2 to hold the cable 3 in place. The cover shells 2 each comprise a receiving open chamber 21, which receives one shielding shell 1, a neck 22 at one end of the receiving open chamber 21, an end notch 221 on the end of the neck 22, and a stub rod 222 disposed in the neck 22. The shielding shells 1 each comprise a receiving open chamber 11 for receiving a terminal holder, enabling the conductors of the cable 3 to be connected to respective terminals in the terminal holder, a neck 12 disposed at one end of the receiving open chamber 11 and fitted into the neck 22 at one cover shell 2, a through hole 121 disposed through the neck 22 and coupled to the stub rod 222 in one cover shell 2, a retaining flange 123 of smoothly arched cross section for holding down the cable 3, and a bend 122 connected between one lateral side wall of the neck 22 and the retaining flange 123. The bend 122 has one side formed integral with the topmost edge of one lateral sidewall of the neck 22, and an opposite side formed integral with the retaining flange 123. The retaining flange 123 has one side formed integral with the bend 122, an opposite side suspended in the open air, and a middle part curved inwards for receiving the cable 3.

Figure 3:
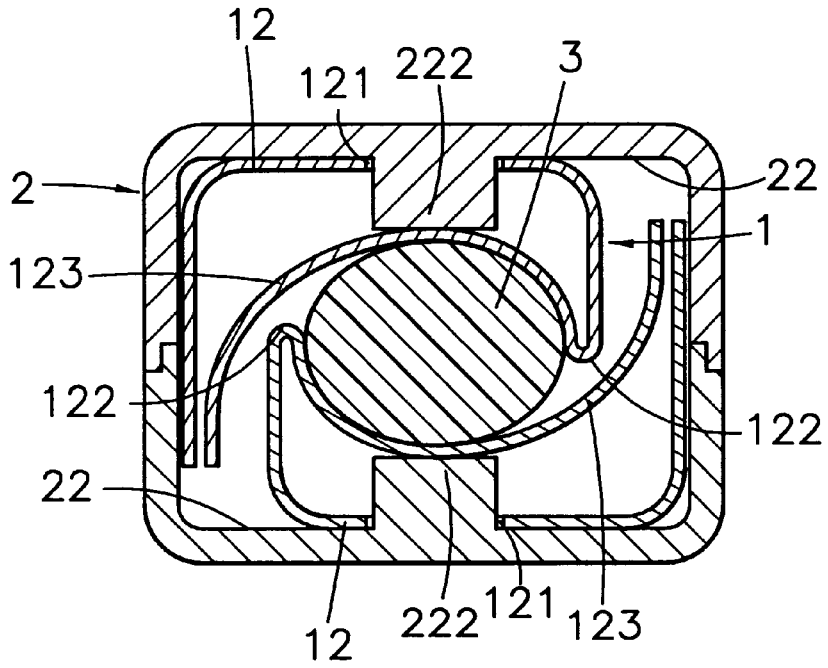
FIG. 3 is a sectional view of the present invention when assembled.

Referring to FIG. 3 and FIGS. 1 and 2 again, the cable 3 is inserted in between the retaining flanges 123 of the two shielding shells 1, then the cover shells 2 are respectively covered on the shielding shells 1, enabling the stub rod 222 of each cover shell 2 to be respectively engaged into the through hole 121 on the neck 12 of each shielding shell 1 and pressed one the retaining flange 123 of each shielding shell 1 against the periphery of the cable 3. When the cover shells 2 are closed together, the retaining flanges 123 of the two shielding shells 1 are forced by the stub rods 222 of the cover shells 2 to hold down the cable 3, and the end notches 221 of the cover shells 2 are closely attached to the periphery of the cable 3 (see FIG. 3).

The two shielding shells 1 are identical metal shells that are inexpensive to manufacture. Simply putting the two shielding shells 1 in the cover shells 2, the cable 3 is positively secured in between the shielding shells 1 when the cover shells 2 are fastened together.

Figure 4:
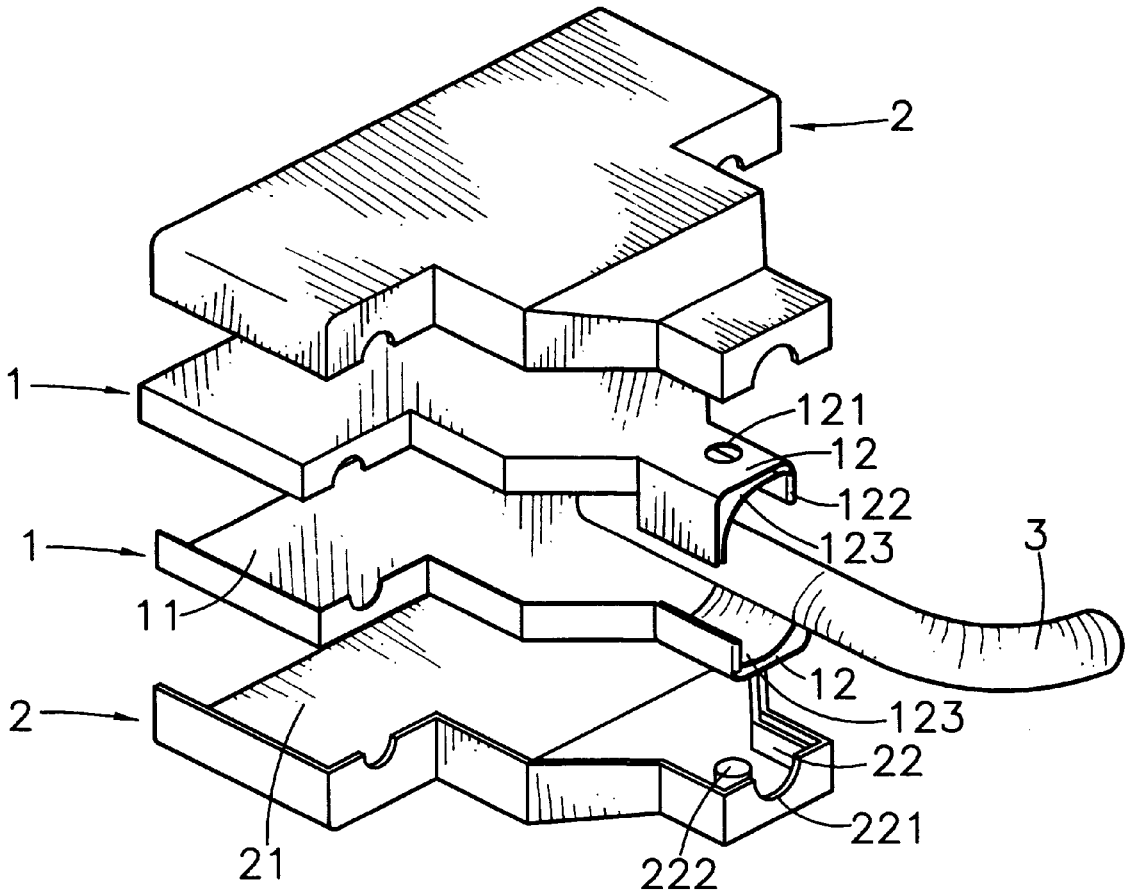
FIG. 4 is an exploded view of an alternate form of the present invention.
Figure 5:
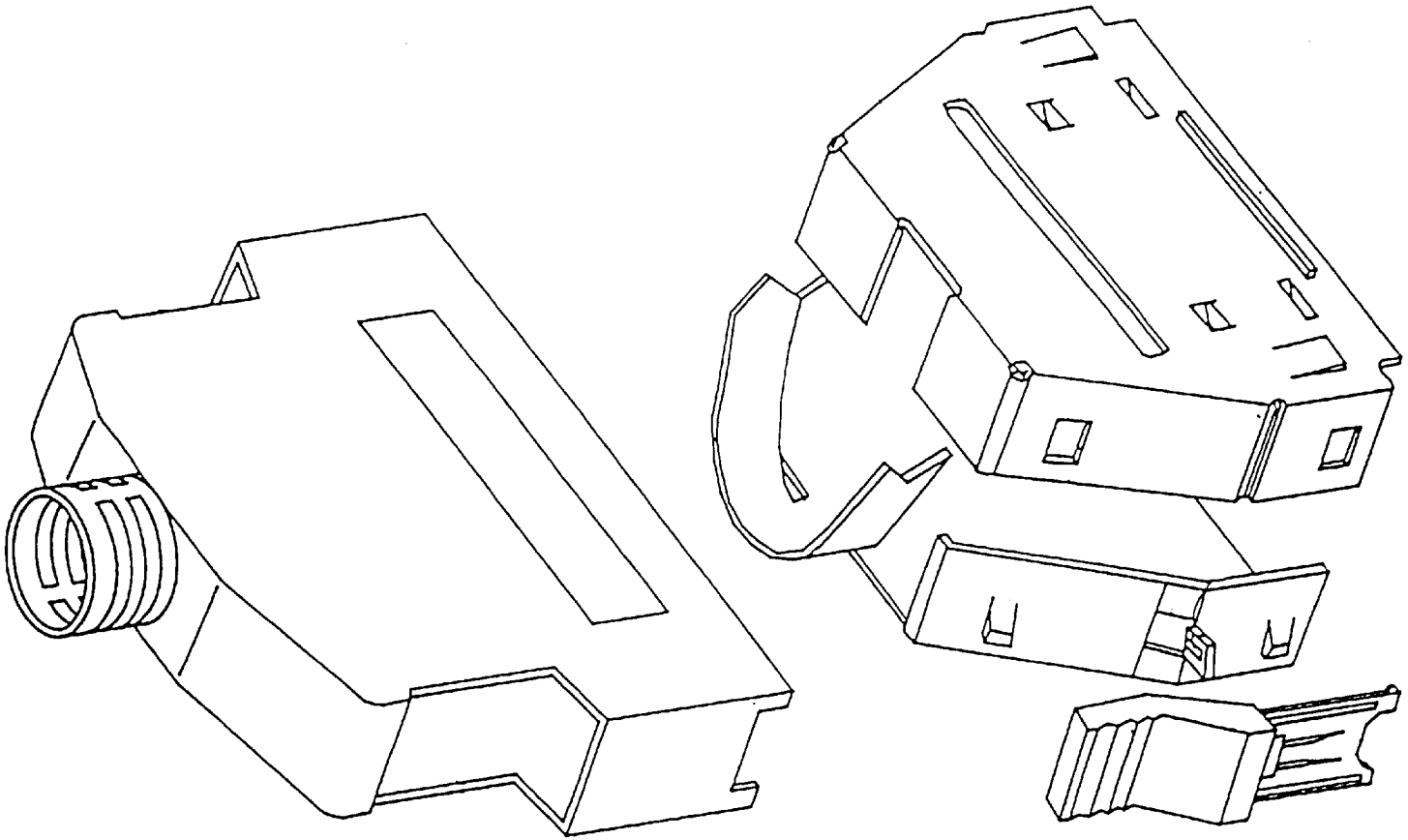
PRIOR ART FIG. 5
FIG. 5 is an exploded view of the prior art.

FIG. 4 shows an alternate form of the present invention. According to this alternate form, each shielding shell 1 comprises a neck 12 at one end, a retaining flange 123 of smoothly arched cross section for holding down the cable 3, and a bend 122 connected between one lateral side wall of neck 22 and the retaining flange 123. The bend 122 has one side formed integral with the front end of one lateral sidewall of the neck 22, and an opposite side formed integral with the retaining flange 123.

It is to be understood that the drawings are designed for purposes of illustration only, and are not intended as a definition of the limits and scope of the invention disclosed.

What the invention claimed is:

1. A metal shield and cable arrangement comprising two cover shells fastened together, two shielding shells made of metal mounted in between said cover shells to hold a terminal holder, and a cable inserted in between said shielding shells and connected to terminals in said terminal holder, wherein said cover shells each comprise a first neck at one end and a stub rod disposed in the first neck; said shielding shells each comprise a second neck fitted into the neck at one cover shell, a through hole coupled to the stub rod in the first neck at one cover shell, and a retaining flange of smoothly arched cross section supported on the stud rod in the first neck at one cover shell and forced by the stub rod against the periphery of said cable.

2. The metal shield and cable arrangement of claim 1 wherein said cover shells each comprise an end notch in the corresponding first neck for the passing of said cable.

3. The metal shield and cable arrangement of claim 1 wherein said retaining flange has one side connected to one lateral side wall of the corresponding first neck through a bend and an opposite side suspended in the open air.

4. The metal shield and cable arrangement of claim 1 wherein said shielding shells are identical metal shells.

5. A metal shield and cable arrangement, comprising:

two cover shells fastened together, said cover shells each comprising a first neck at one end and a stub rod disposed in the first neck; and two shielding shells made of metal mounted in between said cover shells to hold a terminal holder, said shielding shells each comprising a second neck fitted into the first neck of a corresponding one of said cover shells, a through hole coupling the second neck to the stub rod in said corresponding one of said cover shells, and a retaining flange of smoothly arched cross section supported on the stud rod in said corresponding one of said cover shells and forced by the stub rod against the periphery of a cable inserted in between said shielding shells via said first necks and connected to terminals in the terminal holder.

6. The metal shield and cable arrangement of claim 5, with said shielding shells being identical in shape.

7. The metal shield and cable arrangement of claim 5, further comprised of said retaining flange having one side connected to one lateral side wall of the first neck in said corresponding one of said cover shells through a bend and an opposite side suspended in the open air.

8. The metal shield and cable arrangement of claim 7, with said shielding shells being identical in shape.

9. The metal shield and cable arrangement of claim 5, wherein said cover shells each comprise an end notch at said first neck accommodating passage of the cable.

10. The metal shield and cable arrangement of claim 9, further comprised of said retaining flange having one side connected to one lateral side wall of the first neck in said corresponding one of said cover shells through a bend and an opposite side suspended in the open air.

11. The metal shield and cable arrangement of claim 9, with said shielding shells being identical in shape.

12. A metal shield and cable arrangement, comprising:

two cover shells fastened together, said cover shells each comprising a first neck at one end and a stub rod disposed in the first neck; and two shielding shells made of metal mounted in between said cover shells to hold a terminal holder, said shielding shells each comprising a semi-ring neck with a continuous inner surface folded to form an outer continuous surface substantially coextensive with said inner surface, said semi-ring neck fitting into the first neck of a corresponding one of said cover shells, and with a through hole in said outer surface coupling the semi-ring neck to the stub rod in said corresponding one of said cover shells while said outer surface flexibly supports said inner surface as a retaining flange of smoothly arched cross section supported on the stud rod in said corresponding one of said cover shells and forced by the stub rod against the periphery of a cable inserted in between said shielding shells and connected to terminals in the terminal holder.

13. The metal shield and cable arrangement of claim 12, wherein said cover shells each comprise an end notch at the respective neck accommodating passage of the cable.

14. The metal shield and cable arrangement of claim 12, further comprised of said retaining flange having one side connected to one lateral side wall of the first neck in said corresponding one of said cover shells through a bend and an opposite side suspended in the open air.

15. The metal shield and cable arrangement of claim 12, with said shielding shells being identical in shape.

16. The metal shield and cable arrangement of claim 12, with each said semi-rings being identical in shape.

* * * * *